US005341527A

United States Patent [19]

Schmidt et al.

[11] Patent Number: 5,341,527

[45] Date of Patent: Aug. 30, 1994

[54] BATHTUB WITH INTEGRALLY FORMED LEVELING BASE

[75] Inventors: A. Robert Schmidt, Leonardo; Drew J. Yuhas, Pennington, both of N.J.; Ronald D. Barndt, Tatamy, Pa.

[73] Assignee: American Standard Inc., New York, N.Y.

[21] Appl. No.: 57,245

[22] Filed: Apr. 30, 1993

[51] Int. Cl.[5] ..... A47K 3/02

[52] U.S. Cl. ..... 4/592; 4/593; 4/612; 4/613

[58] Field of Search ..... 4/584, 592, 593, 594, 4/595, 612, 613

[56] References Cited

U.S. PATENT DOCUMENTS

| | | | |
|---|---|---|---|
| D. 282,498 | 2/1986 | Hasse . | |
| D. 314,611 | 2/1991 | Doman . | |
| D. 321,555 | 11/1991 | Dannenberg . | |
| 1,050,071 | 1/1913 | Reed . | |
| 1,940,137 | 12/1933 | Mather | 4/592 |
| 2,079,739 | 5/1937 | Houseweller . | |
| 2,468,347 | 4/1949 | Restall . | |
| 2,534,147 | 12/1950 | Rodman | 4/592 |
| 2,697,231 | 12/1954 | Strand | 4/595 |
| 2,784,417 | 3/1957 | Strand | 4/595 |
| 3,088,124 | 5/1963 | Long | 4/593 |
| 3,800,335 | 4/1974 | Buonara | 4/613 |
| 4,551,869 | 11/1985 | Whitney . | |
| 4,557,004 | 12/1985 | Piana | 4/613 |
| 4,664,982 | 5/1987 | Genovese et al. . | |
| 4,844,944 | 7/1989 | Graefe et al. . | |
| 4,844,955 | 7/1989 | Graefe et al. . | |
| 5,049,443 | 9/1991 | Kuszaj et al. . | |
| 5,129,804 | 7/1992 | Perantoni et al. . | |
| 5,139,833 | 8/1992 | Ohaus . | |

FOREIGN PATENT DOCUMENTS

| | | | |
|---|---|---|---|
| 449548 | 9/1927 | Fed. Rep. of Germany . | |
| 461655 | 6/1928 | Fed. Rep. of Germany . | |
| 1932439 | 1/1970 | Fed. Rep. of Germany . | |
| 185329 | 10/1963 | Sweden . | |
| 562587 | 7/1944 | United Kingdom | 4/593 |

*Primary Examiner*—Henry J. Recla
*Assistant Examiner*—Charles R. Eloshway
*Attorney, Agent, or Firm*—Elaine Brenner Robinson; Ann M. Knab

[57] ABSTRACT

A molded article and the mold for making molded articles are disclosed. The molded article is a sanitary fixture, such as a whirlpool bathtub. The molded article comprises a rigid shell having a finish side and a non-finish side. A rigid material is coated on the rigid shell and integrally forms a leveling base on the bottom side of the rigid shell. Mounting pockets for attaching an apron and mounting areas for attaching a whirlpool motor may also be integrally formed in the rigid material coated on the rigid shell. The mold for manufacturing includes a plurality of cavities for forming leveling runners on the bottom side of the molded article. Additional cavities may be included in the mold for forming mounting areas and mounting pockets on the molded article.

8 Claims, 8 Drawing Sheets

BATHTUB WITH INTEGRALLY FORMED LEVELING BASE

FIELD OF THE INVENTION

The present invention relates to sanitary fixtures such as whirlpool tubs, bathtubs and shower floors which include an integrally formed leveling base.

BACKGROUND OF THE INVENTION

In the development of sanitary fixtures, such as bathtubs, spas and whirlpool tubs, independent wood inserts or separate pans have been used to form a leveling base for the tub fixture. Since a tub is generally inclined towards the drain, it is necessary to provide supports so that the upper surface of the tub is level. Typically, supports are attached to the fixture after manufacture and before or at installation. Sand or cement are alternative support materials which are poured at the desired location, upon which a tub fixture is forced into position.

These additional support structures and materials necessary for leveling and positioning tub fixtures cause delay in the installation process and increase labor. Moreover, higher cost results from the transportation of additional materials.

In the past, metal bathtubs have been fabricated with corrugations and grooves in them to provide support and prevent persons from slipping during use. U.S. Pat. No. 2,468,347 discloses a bathtub comprising inner and outer metal shells separated by insulating material. The outer shell has a plurality of corrugations projecting outwardly beyond the bottom surface of the outer shell to provide a bearing support for the tub. Similarly, U.S. Pat. No. 2,079,739 discloses a bathtub of cast iron, molded with grooves therein in which the surface is thereafter enameled or treated with the conformation of the grooves being preserved. The prior art structures are fabricated of metal to maintain rigidity and strength of complex and intricate shapes.

Attempts have been made to fabricate plastic bathtubs with reinforced floors. The reinforcement is typically provided by a support member connected to the underside of the bathtub floor. Conventional bathtub floor supports include a rigid particle board with a layer of urethane foam in combination with a styrene liner disposed intermediate the particle board and the underside of the floor. Holes are provided in the particle board for the incorporation of legs which raise the tub above the floor and provide space for plumbing pipes and easy access to the drain. Bonding of the styrene liner and the urethane foam to the particle board and the bathtub underside are labor intensive steps which require time and factory space.

U.S. Pat. No. 4,551,869 is directed at an attempt to decrease processing steps in the manufacture of plastic bathtubs. It relates to a plastic bathtub having a floor support including a top rigid panel having an upper side contoured to fit on the underside of the bathtub floor. A plurality of ribs are integrally formed with the top panel and extend therefrom in lattice formation. Seats or holes are provided in the lattice to receive and retain the legs which position the floor support and the plastic bathtub above the floor to provide clearance thereunder. The seats are varied in height along the length of the floor support to provide proper inclination of the bathtub toward the drain. Although the plastic support gives the plastic bathtub the needed rigidity to commercially compete with ceramic and fiberglass bathtubs, it is not integral to the bathtub and must be separately molded to the underside of the bathtub. The bathtub and the floor support are each independently molded from a plastic material. The floor support must then be welded to the plastic bathtub using a solvent cement. The attachment of the separate floor support adds an extra step to the manufacturing process. None of the related prior art shows bathtubs fabricated of non-metals and having integrally formed leveling runners or bottom supports, alone or in combination with mounting pockets for attaching an apron, or a motor mount for attaching a whirlpool motor.

SUMMARY OF THE INVENTION

It is therefore an object of the invention to provide a molded article having an integrally formed support and leveling base to provide strength and integrity to the molded article, decrease labor and time of manufacture, facilitate placement and ease installment of the molded article.

It is another object of the invention to provide a molded article with integrally formed mounting pockets for securely mounting and removing an apron.

It is a further object of the invention to provide a molded article with integrally formed attachment points for securely mounting an object to the fixture while avoiding problems of distortion, vibration and delamination of the shell.

These and other objects are achieved by the present invention which provides a molded article having a rigid shell with a finish side and a non-finish side. The non-finish side of the rigid shell is coated with a hardenable polymeric material, which forms leveling runners integrally to the bottom underside of the shell. In the same step, large regions of plastic material are molded to the underside back and sides of the shell for mounting objects such as a whirlpool motor directly to the molded article. Additionally, mounting pockets or projections may be integrally formed under the rim of the molded article to hold the apron in place thereunder.

The molded article of the present invention is made with a mold receptor adapted to receive a rigid shell leaving a void between the non-finish side of the rigid shell and a side of the mold receptor. The mold receptor is designed with longitudinally extending recesses or cavities in the bottom floor and at least one recess on one of the sides or ends of the mold receptor and a series of small voids along the top rim of each side of the mold receptor. A male mold closing means is adapted for removably engaging the finish side of the rigid shell and sealably retaining the rigid shell to the mold receptor. The mold receptor is coated with a non-stick material such as a releasing agent, Teflon brand coating, a wax coating or a silicon coating.

In the process of making the molded article of the present invention, a rigid shell is loaded onto the mold receptor leaving a void between the mold receptor and a side of the rigid shell. The mold receptor has a series of cavities and recesses therein to form the leveling runners, at least one mounting region and a series of small mounting pockets under the top rim of each side. The rigid shell has a finish side and a non-finish side. A polymeric material is introduced into the void, filling the cavities and recesses of the mold receptor thereby coating the non-finish side of the rigid shell and forming bottom leveling runners, side or end protruding regions and a series of small mounting pockets under the top rim of each side. The molded article is removed from the mold receptor after the polymeric material has sufficiently hardened. A molded article available for immediate installation is formed with integrally formed levelling runners, protruding regions for mounting articles and a series of mounting pockets for attaching an apron. There is no need to additionally or separately attach bottom supports to the molded article.

BRIEF DESCRIPTION OF THE DRAWINGS

The invention will be more fully appreciated from the following detailed description when the same is considered in connection with the accompanying drawings in which.

DETAILED DESCRIPTION OF THE INVENTION

Figure 1:
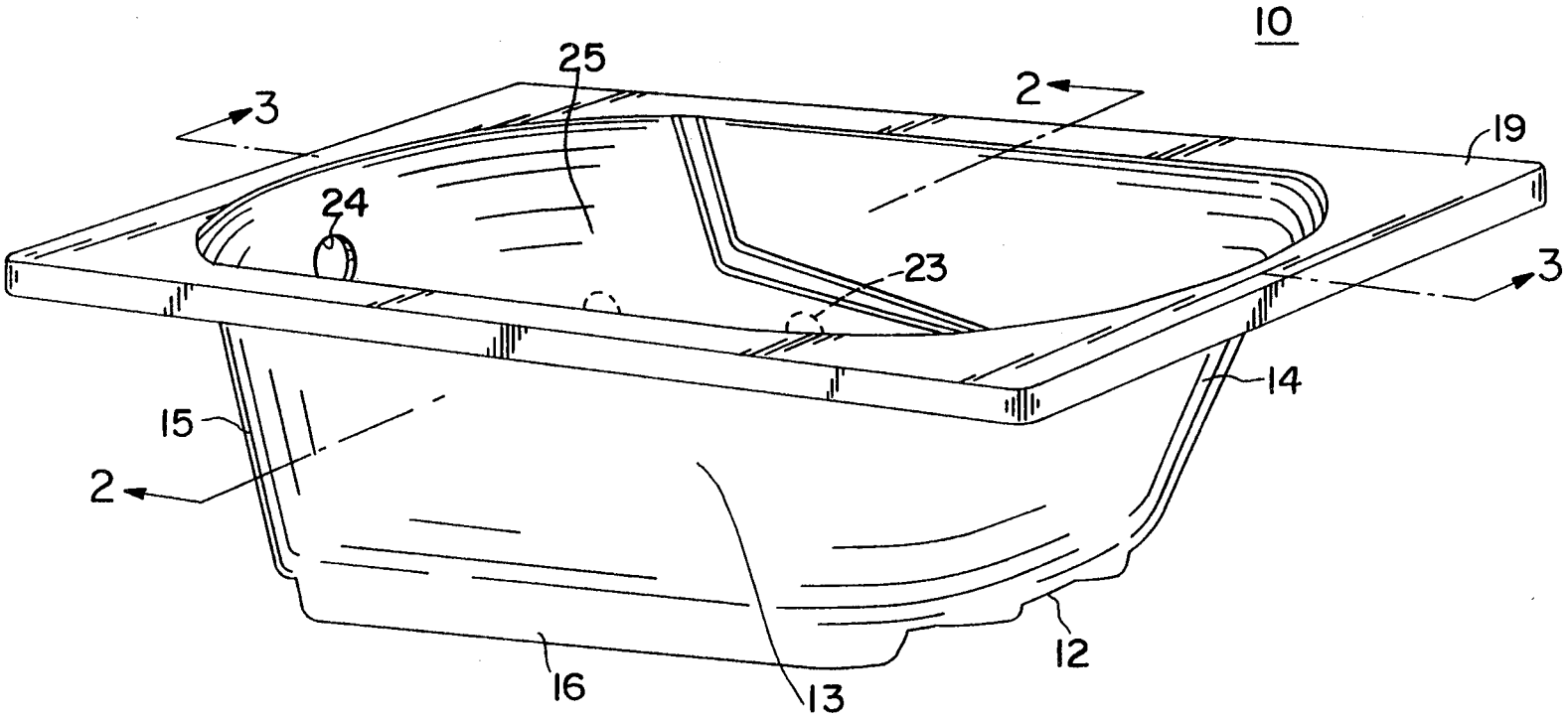
FIG. 1 is a perspective view of a molded whirlpool tub according to the present invention.
Figure 2:
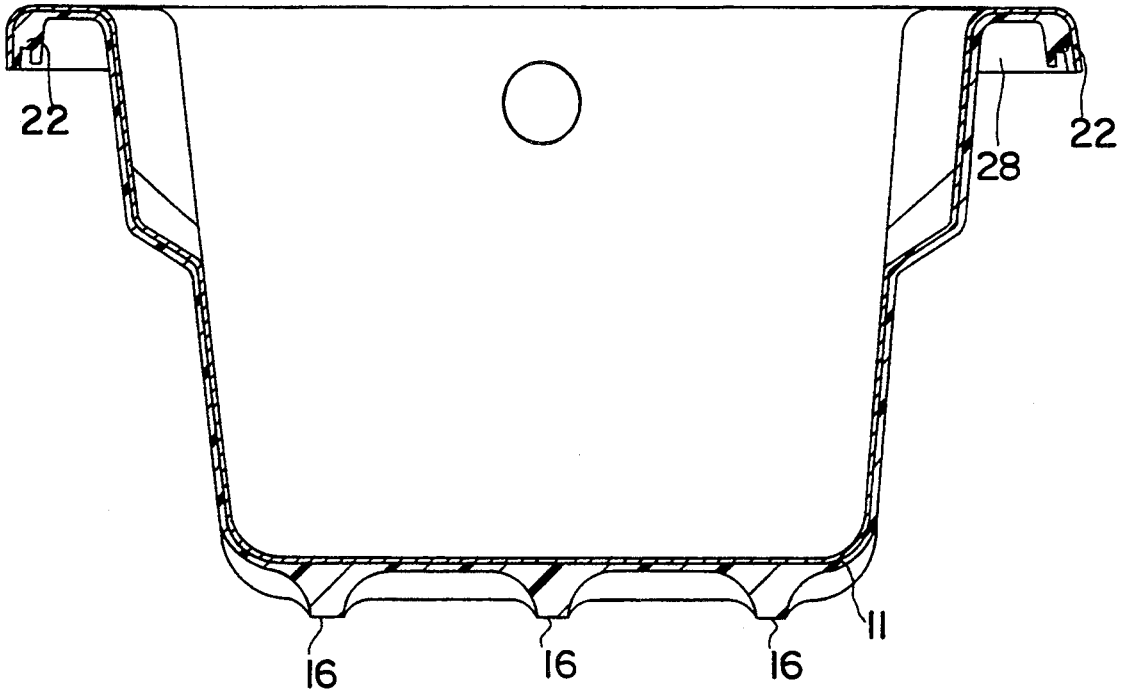
FIG. 2 is a cross-sectional view taken along line 2—2 of FIG. 1.

A molded tub 10 in accordance with the present invention is shown in FIGS. 1 through 4. The molded tub 10 includes a base 12 and sides 13 which may be perpendicular to the base or upwardly diverging to a small degree. Ends 14 and 15 extend obliquely with respect to base 12, end 14 inclined substantially greater than end 15.

Figure 4:
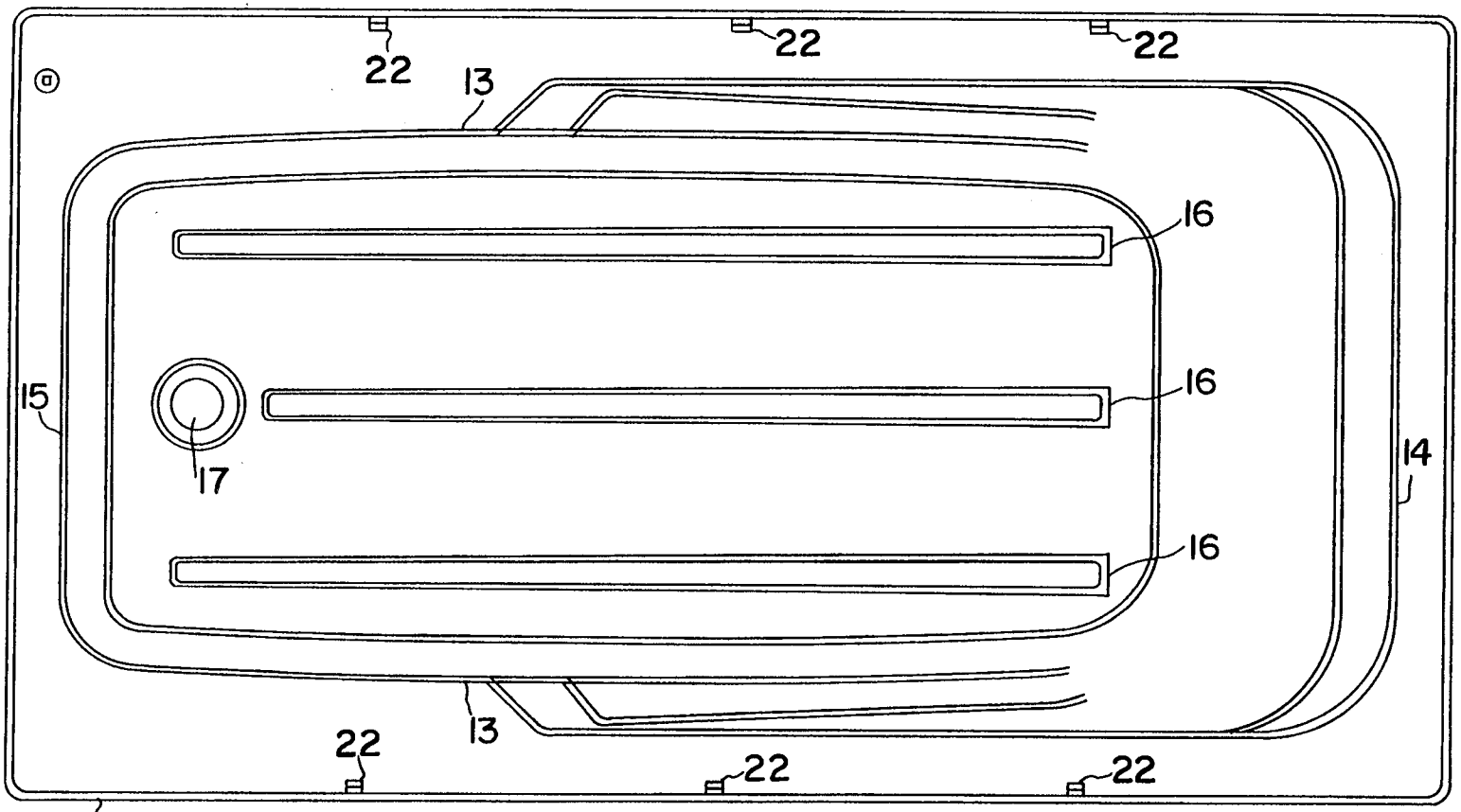
FIG. 4 is a bottom plan view of the molded whirlpool tub of FIG. 1.

The base of the tub is integrally formed with a plurality of leveling runners 16 which extend longitudinally along the length of the base of the tub. The runners project outwardly from the exterior surface of the base to provide a support and leveling means. As best shown in FIG. 4, two of the leveling runners project along the length of the edges of the base, end to end, and adjacent the bottom edge of sides 13. A third leveling runner is disposed halfway between the edge runners, along the length of the base of the tub from end 14 terminating at a point adjacent the drain opening 17.

Figure 3:
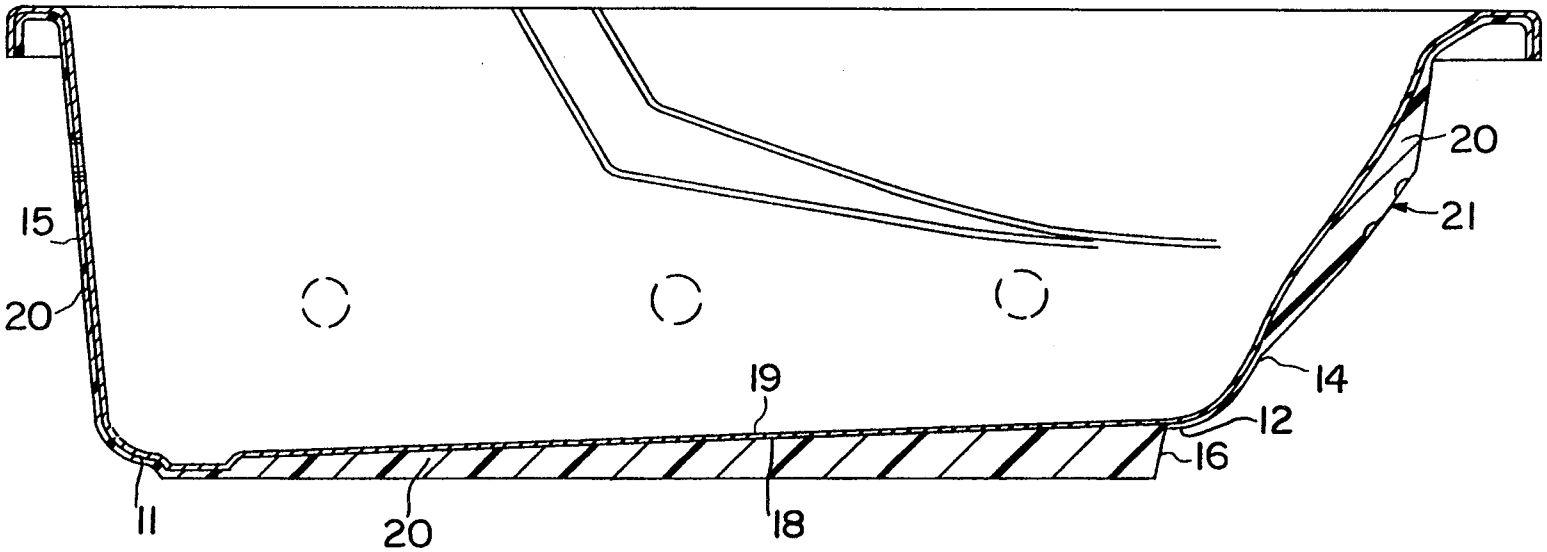
FIG. 3 is a cross-sectional view taken along line 3—3 of FIG. 1.

FIG. 3 illustrates the degree of inclination provided by the leveling runners. The tub is inclined higher at end 14 for drainage purposes. Accordingly, the leveling runners are greater in height at end 14.

The molded tub 10 includes a rigid shell 11 having a non-finish side 18 and a finish side 19. Non-finish side 18 is not ordinarily exposed to view after installation, while the finish side 19 is normally seen and contacted by the user after the tub has been installed. Non-finish side 18 of rigid shell 11 is coated with a polymeric material coating 20 which forms the leveling runners and supports 16, the whirlpool motor mount 21 on end 14 and mounting pockets 22. Suitably, the molded tub 10 may also include venturi nozzles 23, an overflow drain 24, and reservoir 25.

Figure 5:
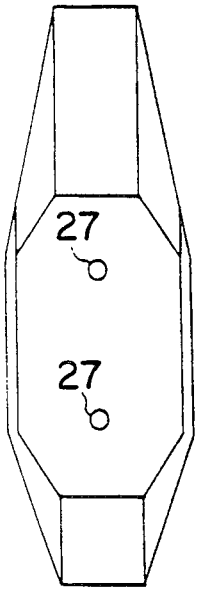
FIG. 5 is a plan view of a whirlpool motor mount section of the bathtub.
Figure 6:
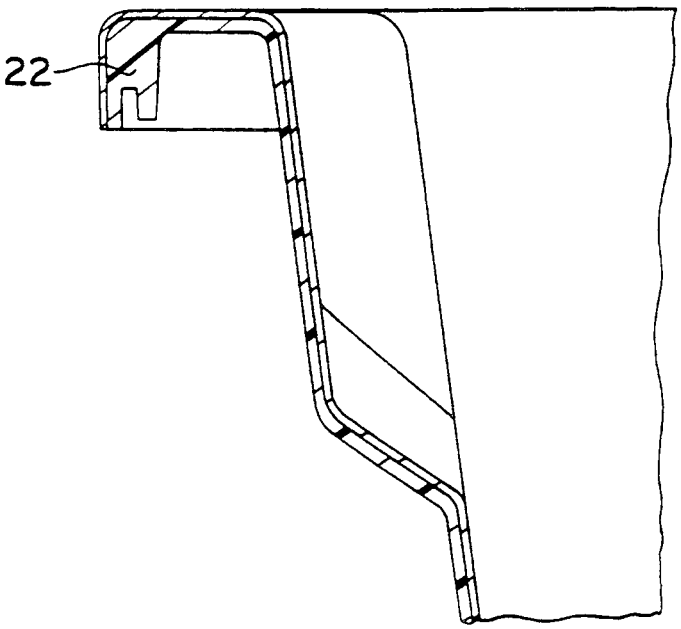
FIG. 6 is an enlarged view of a mounting pocket illustrated in FIG. 2.

As best depicted in FIG. 5, holes 27 may be drilled in the motor mount 21 for insertion of mounting bolts for attaching a motor. The invention is not limited to motor mounts, and may include integrally molded projections or mounting pads on other areas of the tub for mounting similar objects. The molded tub 10 also includes integrally formed mounting pockets 22 under rim 28 of the tub to hold an apron in place. FIG. 6 is an enlarged view of a mounting pocket 22.

Rigid shell 11 may be constructed from steel, fiberglass, polymeric materials and/or composite materials and methods as disclosed in commonly assigned U.S. Pat. Nos. 4,844,944 and 4,844,955 to Graefe et al. end commonly assigned U.S. Pat. No. 5,049,433 to Kuszaj et al., the disclosures of which are incorporated by reference herein. In accordance with the invention, the rigid shell is coated with a polymeric material 20. Suitable polymeric materials for coating the rigid shell are discussed in the commonly assigned U.S. Pat. No. 4,664,982 to Genovese et al., the disclosure of which is incorporated by reference herein, as well as the aforementioned U.S. Pat. Nos. 4,844,944, 4,844,955 and 5,049,433.

Figure 7:
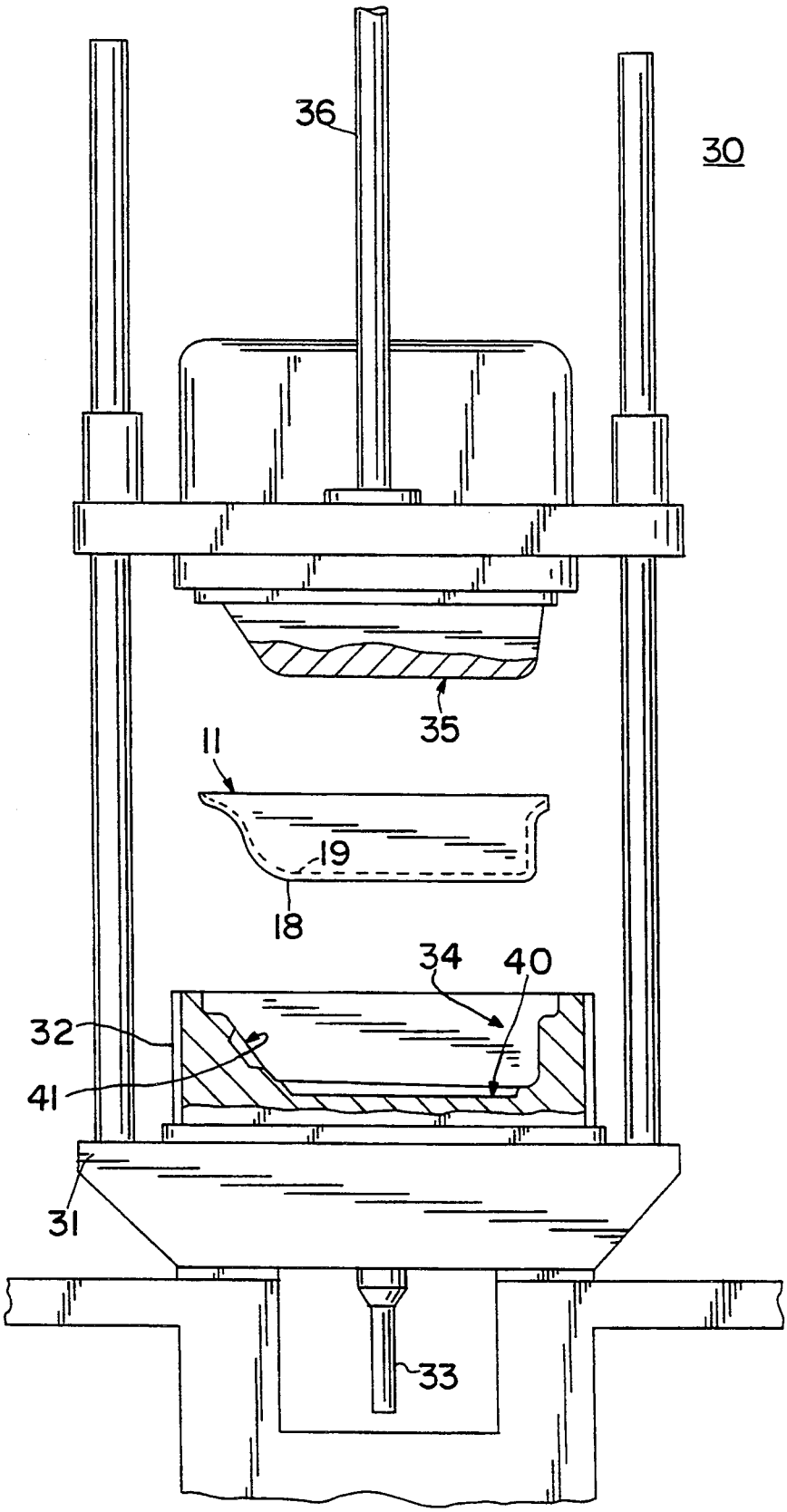
FIG. 7 is a side elevational view illustrating a mold press for use with the present invention.

The molded tub 10 of the present invention is made using a mold press 30 illustrated in FIG. 7. Mold press 30 includes a platform 31 onto which a mold receptor 32 is mounted. A mix head 33 is positioned below platform 31 for injecting the polymeric material 20 through a conduit in platform 31 and into mold receptor 32.

Mold receptor 32 is adapted to receive a rigid shell 11 leaving a void between the non-finish side 18 of the rigid shell 11 and the mold receptor face 34. The mold receptor face 34 also includes voids or recesses 40, 41 and 42 for forming the leveling runners 16, motor mount 21 and mounting pockets 22, respectively.

Figure 8:
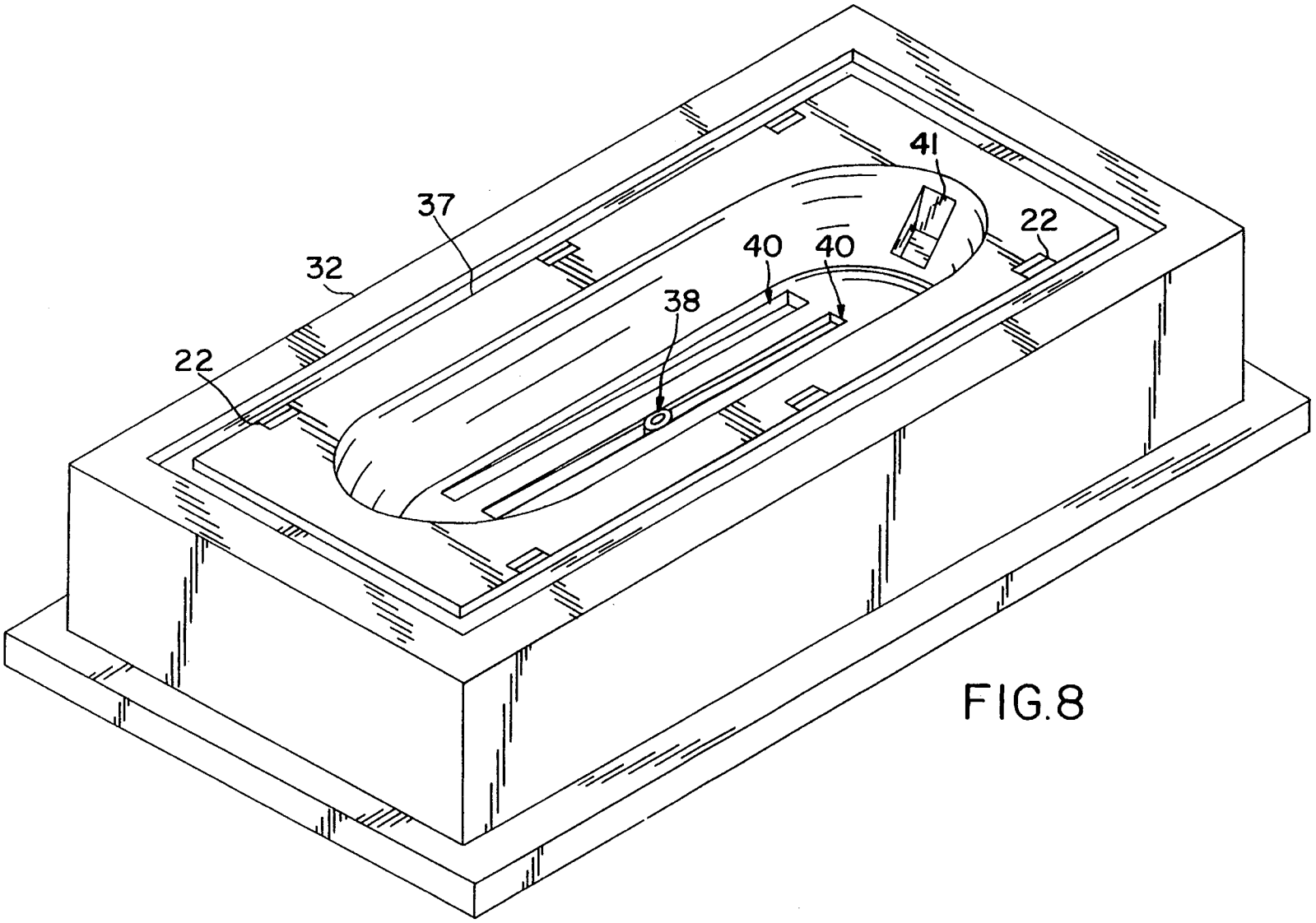
FIG. 8 is a perspective view of a mold receptor.

Preferably, a male mold closing means 35 is adapted for removably engaging the finish side 19 of the rigid shell 11. The male mold closing means 35 has an elastomeric surface which snugly fits into the tub interior, sealably retaining rigid shell 11 in mold receptor 32, forming a closed cavity between the mold receptor face 34 and the rigid shell's non-finish side 18. Male mold closing means 25 also helps to minimize warp, bowing and distortion of the rigid shell during the injection molding process. A hydraulically operated system 36 lowers and retains the male mold closing means 35 against the rigid shell 11 and mold receptor 32 during the molding process. A mold press 30 which is suitable for molding bathtubs including the present invention is manufactured by Linden Industries, Inc. Preferably, the mold receptor 32 includes a seal 37 as shown in FIG. 8. Seals suitable for use with the present invention are described in concurrently filed and commonly assigned U.S. patent application Ser. No. 07/931,436 which is incorporated by reference herein. Other molds suitable, or which may be suitably adapted, for use with the present invention are disclosed in co-pending and commonly assigned U.S. Pat. No. 5,129,804, also incorporated by reference herein.

Figure 9:
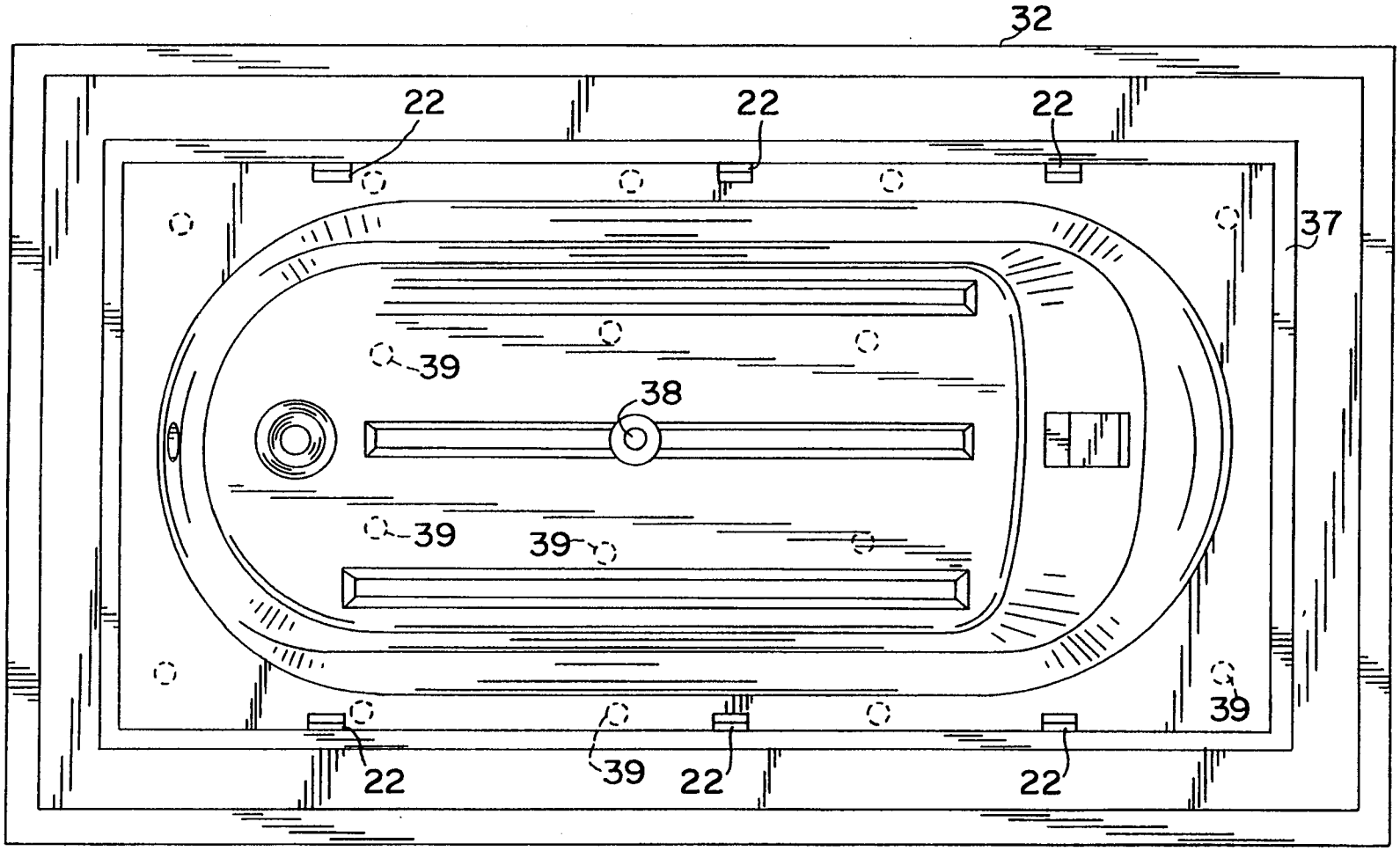
FIG. 9 is a top plan view of the mold receptor illustrated in FIG. 8.

As illustrated in FIGS. 8 and 9, aperture 38 of mold receptor 32 communicates with a mix head 33 for introducing the hardenable polymeric material into the void created between the mold receptor face 34 and the rigid shell 11. A plurality of ejectors 39 are positioned in the mold receptor 32 which serve to separate and eject the molded tub 10 from the mold receptor 32 after the molding process has been completed. Preferably, the ejectors are cylindrical rods which are hydraulically activated, from a recessed position to an ejected position and vice versa. Optionally, the mold receptor may be coated with a non-stick material. The non-stick material is preferably a releasing agent, a TEFLON synthetic resin polymer, a wax coating or a silicon coating.

In the preferred process of making the molded tub 10 of the present invention, rigid shell 11 is loaded onto a mold receptor 32. A void is left between the mold receptor 32 and a side of the rigid shell 11. During the molding process, hardenable polymeric material 20 is introduced from the mix head through aperture 38 in mold receptor 32, filling the mold cavity. The hardenable polymeric material 20 is injected under suitable molding pressure and coats the non-finish side 18 of rigid shell 11 to form the molded tub 10.

After the molded polymeric material 25 has sufficiently hardened, the male mold closing means 35 is retracted. Preferably, the molded tub 10 is lifted partially out of the mold receptor 32 by hydraulic ejectors 39. The ejectors 39 force the molded tub 10 upwards and the molded tub 10 is then manually or mechanically removed from the mold receptor 32. A molded article available for immediate installation is formed with integrally formed leveling runners, protruding regions for mounting articles and a series of mounting pockets for attaching an apron. There is no need to additionally or separately attach bottom supports to the molded article.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A molded article comprising:

a rigid shell having a finish side and a non-finish side, said rigid shell comprised of a bottom wall, left and right side walls, and a pair of end walls;

said rigid shell further having an interior and an exterior, said interior and exterior defined by said bottom wall, said left and right side walls, and said end walls, and wherein said finish side corresponds to said interior and said non-finished side corresponds to said exterior;

a single-layer rigid coating on said non-finish side of said shell forming a hardened exterior, said rigid coating covering the entire non-finish side; and a leveling base integrally formed in said hardened exterior on the bottom side of said rigid shell.

2. The molded article of claim 1 wherein said rigid coating is formed from a hardenable polymeric material.

3. The molded article of claim 2 wherein said rigid shell is constructed of metal, plastic, fiberglass or polymeric material.

4. The molded article of claim 3 wherein said molded article is a sanitary fixture.

5. The molded article of claim 4 wherein said sanitary fixture is a bathtub, whirlpool bathtub or shower floor.

6. The molded article of claim 1 wherein said leveling base includes a series of longitudinally extending runners disposed from end to end on said bottom side of said rigid shell.

7. The molded article of claim 1 further including mounting areas formed integrally in said hardened exterior on said rigid shell for attaching objects to said hardened exterior and having a thickness greater than the thickness of the surrounding area of said hardened exterior.

8. The molded article of claim 1 further including mounting pockets formed integrally in said hardened exterior on said rigid shell.

* * * * *